US008205967B2

(12) United States Patent
Uyama et al.

(10) Patent No.: US 8,205,967 B2
(45) Date of Patent: Jun. 26, 2012

(54) LIQUID EJECTION HEAD AND MANUFACTURING METHOD THEREOF

(75) Inventors: Masaya Uyama, Kawasaki (JP); Makoto Terui, Yokohama (JP); Kazuhiro Hayakawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 543 days.

(21) Appl. No.: 12/393,235

(22) Filed: Feb. 26, 2009

(65) Prior Publication Data

US 2009/0212008 A1 Aug. 27, 2009

(30) Foreign Application Priority Data

Feb. 27, 2008 (JP) ..... 2008-046074

(51) Int. Cl.
*B41J 2/05* (2006.01)
*B41J 2/04* (2006.01)

(52) U.S. Cl. ..... 347/64; 347/54

(58) Field of Classification Search ..... 347/54, 347/64

See application file for complete search history.

(56) References Cited

U.S. PATENT DOCUMENTS

| | | | | |
|---|---|---|---|---|
| 6,390,606 | B1 | 5/2002 | Terui et al. | |
| 6,715,860 | B2 * | 4/2004 | Watanabe | 347/68 |
| 7,022,609 | B2 | 4/2006 | Yamamoto et al. | |
| 2008/0116167 | A1 | 5/2008 | Uyama | |
| 2008/0173616 | A1 * | 7/2008 | Sakurai | 216/27 |

FOREIGN PATENT DOCUMENTS

| | | | |
|---|---|---|---|
| JP | 09-011478 | * | 1/1997 |
| JP | 2001-270118 | A | 10/2001 |

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head includes a substrate, having a front surface and a back surface, provided on the front surface with an energy generating element for generating energy used for ejecting liquid; a supply port, provided so as to penetrate between the front surface and the back surface of the substrate, for supplying the liquid to the energy generating element; a first film provided on the front surface of the substrate; and a second film provided so as to coat a wall of the substrate defining the supply port. The first film and the second film surface-contact each other with respect to two directions substantially perpendicular to each other.

3 Claims, 6 Drawing Sheets

LIQUID EJECTION HEAD AND MANUFACTURING METHOD THEREOF

FIELD OF THE INVENTION AND RELATED ART

The present invention relates to a liquid ejection head for ejecting liquid and a manufacturing method thereof. Specifically, the present invention relates to an ink jet recording head for ejecting ink onto a recording material (medium) to effect recording and a manufacturing method thereof.

As an example of the liquid ejection head for ejecting liquid, an ink jet recording head (ink jet head) used in an ink jet recording apparatus and an ink jet recording method.

In the ink jet recording apparatus, ink in the form of minute liquid droplet is ejected from a plurality of ink ejection outlets arranged on the ink jet head, thus carrying out image recording.

Generally, a single crystal silicon substrate having (100) surface as crystal orientation on a surface substrate (hereinafter simply referred to as a "silicon substrate") is provided with an ink supply port penetrating between the front surface and the back surface of the silicon substrate in the ink jet head. However, the silicon substrate is corroded by the ink, so that the ink jet head was accompanied with a problem that the ink supply port had to be prevented from being subjected to propagation of corrosion.

In a convention ink jet head, the ink supply port is formed by crystal anisotropic etching with alkaline liquid. In this etching, as an etching surface, (111) surface which is a close-packed surface of silicon is exposed. By utilizing an etching rate at the (111) surface which is very slow compared with those of other crystal faces, the propagation of corrosion of the ink supply port by the ink has been prevented.

However, ink jet printers in recent years have been required to be provided to consumers as products with high quality, high definition and high throughput. As a means for reducing cost of the ink jet printer, a means for reducing cost of a print head may be used. As one of methods for achieving such a means, a method in which the number of available chips from a single wafer is increased may be employed.

In formation of the ink supply port by using the crystal anisotropic etching in the conventional ink jet head, the ink supply port is formed with an angle of 54.7 degrees with respect to a flat surface of the silicon substrate, thus occupying an area larger than a desired with the ink supply port. For this reason, it is desired that a minimum necessary occupied area of the ink supply port is provided by forming the ink supply port with an angle larger than the conventional angle (54.7 degrees) to improve the number of available chips per (one) wafer.

However, when the ink supply port is formed under the above-described condition, it is necessary to form a protecting film for protecting the silicon substrate from the ink since a wall of the silicon substrate defining the ink supply port has no (111) surface.

As a technique for protecting the inner wall surface of the ink supply port, Japanese Laid-Open Application (JP-A) 2001-270118 discloses a constitution of an ink jet head. The ink jet head disclosed in JP-A 2001-270118 will be described with reference to FIG. 2. The ink jet head shown in FIG. 2 has such a structure that a glass surface 250 on which a recording element and a flow passage are formed and a circuit substrate 200 on which a glass mesh material and an epoxy resin film are laminated are bonded to each other through an adhesive film 360. The circuit substrate 200 is provided with an opening 210 at a position opposite to an opening 350 penetrating through the glass substrate 250 to provide an ink supply port. At an end portion of the opening 210, a protecting film is formed. This protecting film includes a metal film 20-1 of Ni as an under layer for plating provided at an end portion of the circuit substrate 200, a gold-plated film 20-2 formed on the under metal film, and a protecting film 20-3 formed of an organic resin material on the gold-plated film 20-2.

When the flow passage is formed after the supply port is formed, accuracy of the flow passage is lowered due to a lowering in rigidity of the substrate and unavailability of a spin coat method. For this reason, a flow passage-forming material is disposed on one of surfaces of a substrate in the ink jet head using the silicon substrate as the substrate, so that the ink supply port may preferably be formed by processing the substrate from the back surface and the substrate.

However, in the ink jet head disclosed in JP-A 2001-270118, the structure of the protecting film formed at a side surface of the opening of the circuit substrate is such a structure that it is difficult to form the protecting film by the processing from the back surface of the substrate, so that it is difficult to apply the structure of the protecting film to the silicon substrate on which the flow passage is formed.

As a method of forming a through hole electrode, U.S. Pat. No. 7,022,609 discloses a technique for forming a protecting film at a side wall portion of an opening formed from a back surface of a substrate as shown in FIG. 3. Referring to FIG. 3, on both surfaces of a silicon substrate 110, a first protecting film 120 which is a thermal oxidation film is formed. The silicon substrate 110 is provided with an opening 170 penetrating through the first protecting film 120 and the silicon substrate 110 and is coated with a second flow passage 130 at a side wall portion of the silicon substrate 110 so as to define the opening 170.

The first protecting film 120 and the second protecting film 130 are an oxide film formed by thermal oxidation. The second protecting film 130 can also be formed by a chemical vapor deposition (CVD) method or the like in U.S. Pat. No. 7,022,609.

However, different from the case of the through hole electrode, in the case of an ink jet head of a thermal bubble generation type, a substrate is subjected to heat cycle in order to eject liquid droplets, so that stress attributable to thermal expansion of a substance is intermittently exerted on an interface between the first protecting film and the second protecting film.

In the case of the thermal oxidation film, it has been known that silicon of the substrate reacts with oxide to form a silicon oxide film, thus causing volume expansion. The interface between the first protecting film and the second protecting film which is obtained by subjecting the silicon surface exposed to the opening at the side wall portion of the substrate to oxidation by thermal oxidation is placed in a state in which stress by the second protecting film is applied. For this reason, in the case where the stress by the heat cycle is applied, crack occurs between the first protecting film and the second protecting film, so that the ink can soak into the substrate through the crack.

U.S. Pat. No. 7,022,609 discloses that the protecting film can be formed by a plasma CVD method or a sputtering method other than the thermal oxidation. In the case of using the film-forming method such as the CVD method or the like, growth of the silicon oxide film in a thickness of 1 μm or more impairs productivity of a device in some cases.

However, different from the case of the through hole electrode, in the case of the ink jet head of the thermal bubble generation type, the substrate is subjected to heat cycle in order to eject the liquid droplets as described above. In the case where the material for the protecting film is an inorganic material such as silicon oxide or silicon nitride, even when the same material is used, the stress attributable to thermal expansion is intermittently exerted on the interface between the first protecting film and the second protecting film. As a result, the crack occurs at the interface in some cases.

Further, in the case where the first protecting film and the second protecting film are formed of the inorganic material and the organic material, it is difficult to sufficiently ensure adhesiveness between the first protecting film and the second protecting film.

SUMMARY OF THE INVENTION

A principal object of the present invention is to provide a constitution of an ink supply port protecting film capable of being formed only by processing from a back surface of a substrate with high reliability.

Another object of the present invention is to provide a manufacturing method for facilitating the provision of such a constitution.

In order to achieve these objects, according to an aspect of the present invention, there is provided a liquid ejection head having a constitution described below.

According to another aspect of the present invention, there is provided a manufacturing method of the liquid ejection head.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
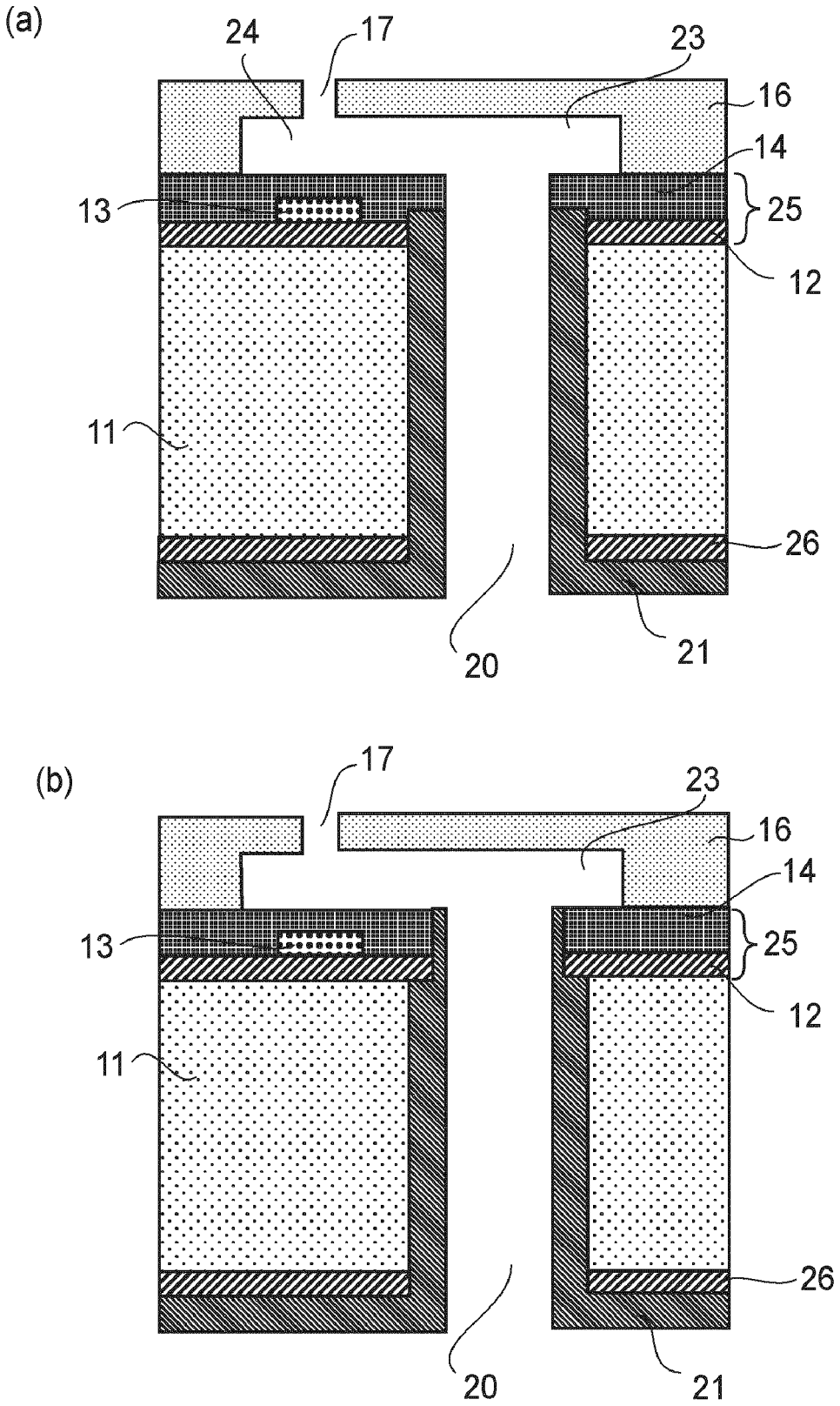
FIGS. 1(*a*) and 1(*b*) are representative sectional views each showing a supply port provided with a protecting film in an ink jet head according to the present invention.
Figure 2:
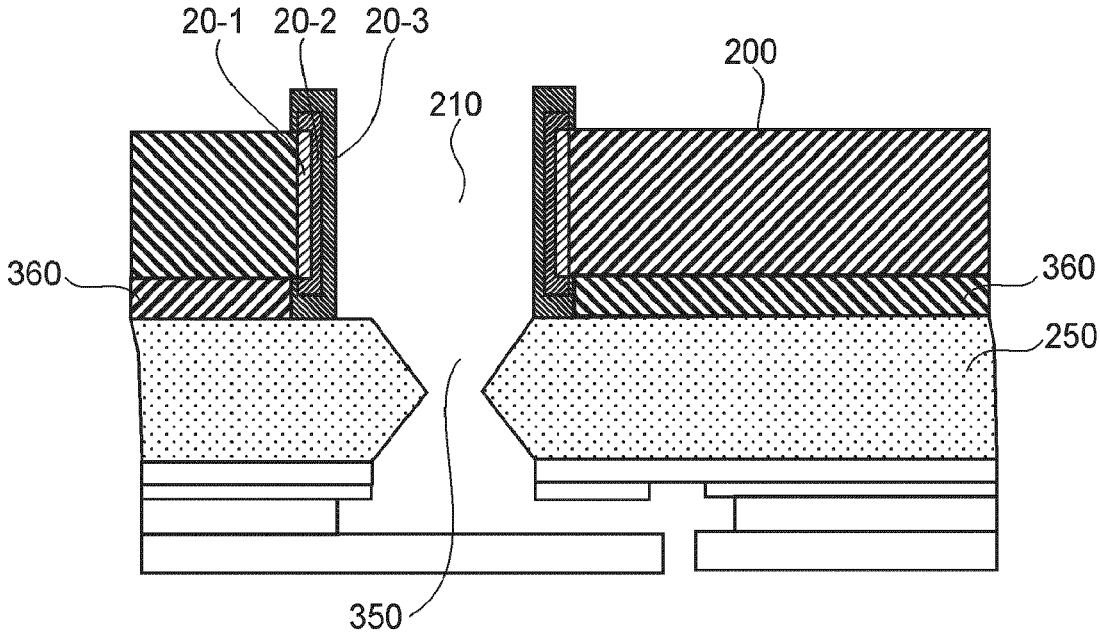
FIG.2 PRIOR ART
FIG. 2 is a sectional view showing an ink supply port of a conventional ink jet head.
Figure 3:
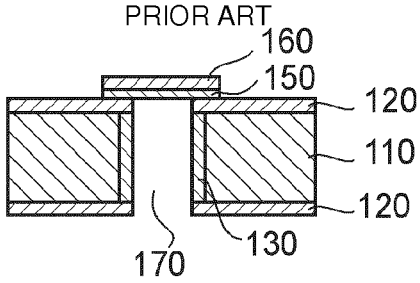
FIG.3 PRIOR ART
FIG. 3 is a sectional view for illustrating a conventional technique for forming a through hole electrode.

Hereinbelow, embodiments of the present invention will be described with reference to the drawings.

In the following description, constituent members or portions having the same functions are represented by the same reference numerals and are omitted from explanation in some cases.

In the following embodiments, an ink jet recording method will be described as an applied embodiment of the present invention. However, the present invention is not limited thereto but may also be applicable to biochip preparation, electronic circuit printing, etc.

The liquid ejection head is mountable to a printer, a copying machine, a facsimile machine including a communication system, a device such as a word processor including a printer portion, and industrial recording devices compositively combined with various processing devices. For example, the liquid ejection head can also be used for biochip preparation, electronic circuit printing, ejection of medication in the form of spray, etc. For example, by using this liquid ejection head for the purpose of recording, it is possible to carry out recording on various recording media (materials) such as paper, thread, fiber, fabric, leather, metal, plastic, glass, wood, and ceramics. Herein, the term "recording" means not only that a significant image such as a character image or a graphical image is provided to the recording material but also that an insignificant image such as a pattern image is provided to the recording material.

In the present invention, even when a material, for a substrate such as a silicon substrate, which can be subjected to corrosion with liquid such as ejected ink or the like is used, it is possible to provide a liquid ejection head having a sufficiently protected side surface facing an opening.

The liquid ejection head of the present invention includes a substrate on which a first protecting film, a recording element, a flow passage, and an ejection outlet communicating with the flow passage are formed at one of surfaces of the substrate (an upper surface or a front surface). From the other surface (a lower surface or a back surface) of the substrate, a supply port which penetrates through the substrate and the first protecting film and is connected to the flow passage so as to supply liquid to the flow passage is provided and a second protecting film for protecting a side surface of the supply port is provided. The first protecting film and the second protecting film are provided so that an end surface of one of the protecting films is covered (coated) with the other protecting film at a connecting portion between the flow passage and the supply port and so that part of the other protecting film is covered (coated) with the one of the protecting films at the connecting portion. Specifically, the first protecting film and the second protecting film may have the following structures (A) and (B):

(A) Structure in which an end surface of the first protecting film is covered with the second protecting film and part of an end surface of the second protecting film is covered with the first protecting film, and (B) Structure in which the end surface of the second protecting film is covered with the first protecting film and part of the end surface of the first protecting film is covered with the second protecting film.

That is, in the liquid ejection head of the present invention, not only an end portion of one protecting film which covers the second surface at the supply port for supplying the liquid to the flow passage is covered with the other protecting film at the connecting portion between the flow passage and the supply port but also at least one of the protecting films has a protruded end portion such that the end portion constitutes a stepped portion. The protruded end portion of one protecting film is covered with the other protecting film, so that a length of the interface between the first protecting film and the second protecting film is increased. Thus, even in the case where the liquid permeate through the interface, a time until the liquid reaches the substrate is increased, so that a time until the liquid is exposed to the liquid is prolonged.

Further, at least one of the first protecting film and the second protecting film may be a lamination film having two or more layers.

The stepped portion may have two or more stepped sections.

By the stepped portion, a length of the interface between the first protecting film and the second protecting film is prolonged. Further, the first protecting film and the second protecting film are connected to each other in stepped state, so that a bonding strength between the first protecting film and the second protecting film is increased. Even when the first protecting film formed of the inorganic material such as silicon oxide and the second protecting film formed of an organic resin material are used in combination, a sufficient bonding strength is obtained. As a result, a heat generating element to be heated during ejection can be used as the recording element and thus can be used for the liquid ejection head in which the first protecting film and the second protecting film are subjected to the heat cycle (alternating heating and cooling).

As a material for the organic resin film, it is preferable that at least one material selected from the group consisting of polyparaxylylene, polymonochloroparaxylylene, polydichloroparaxylylene, polytetrafluoroparaxylylene, another paraxylylene derivative, polyurea resin, and polyimide resin is used.

In the present invention, the liquid ejection head including the substrate on which the first protecting film, the recording element, the flow passage, and the ejection outlet communicating with the flow passage are formed at one of the surfaces of the substrate and including the supply port which penetrates through the substrate and the first protecting film and is connected to the flow passage so as to supply the liquid to the flow passage and further including the second protecting film for protecting the side surface of the substrate facing the supply port can be manufactured by the following two methods.

(First Method)

The first method includes the following steps (i), (ii) and (iii):

(i) a step of forming, on an upper surface of the substrate, the first protecting film, the recording element, a resin pattern constituting the flow passage, and an orifice plate covering the resin pattern, and (ii) a step of providing the supply port which is extended from a lower surface of the substrate and reaches the resin pattern formed on the upper surface of the substrate, and then (iii) a step of forming the flow passage by removing the resin pattern through the supply port.

The resin pattern is formed in contact with the first protecting film. The step of providing the supply port (step (ii)) includes the following steps (1) to (5):

(1) a step of providing an opening extending from the lower surface of the substrate to reach the first protecting film, (2) a step of removing part of the first protecting film exposed to the opening, (3) a step of forming the second protecting film at least at an inner side surface of the substrate defining the opening, (4) a step of exposing a remaining portion of the first protecting film by removing the second protecting film formed on the remaining portion of the first protecting film at the opening while leaving the second protecting film located at the side (inner) surface of the substrate facing the opening, and then (5) a step of providing the supply port which reaches the resin pattern by removing the remaining portion of the first protecting film exposed into the opening.

(Second Method)

The second method includes the following steps (i), (ii) and (iii):

(i) a step of forming, on an upper surface of the substrate, the first protecting film, the recording element, a resin pattern constituting the flow passage, and an orifice plate covering the resin pattern, and (ii) a step of providing the supply port which is extended from a lower surface of the substrate and reaches the resin pattern formed on the upper surface of the substrate, and then (iii) a step of forming the flow passage by removing the resin pattern through the supply port.

The resin pattern is formed in contact with the first protecting film. The step of providing the supply port (step (ii)) includes the following steps (1) to (5):

(1) a step of providing an opening extending from the lower surface of the substrate to reach the first protecting film, (2) a step of removing part of the first protecting film exposed to the opening, (3) a step of forming the second protecting film at least at an inner side surface of the substrate defining the opening, (4) a step of exposing a remaining portion of the first protecting film by removing the second protecting film formed on the remaining portion of the first protecting film at the opening while leaving the second protecting film located at the side (inner) surface of the substrate facing the opening, and then (5) a step of exposing the remaining portion of the first protecting film at a bottom of a portion corresponding to the opening by repeating the above-described steps (2) to (4) once or plural times with respect to a structure in the opening obtained through the step (4), (6) a step of providing the supply port which reaches the resin pattern by removing the remaining portion of the first protecting film exposed into the opening.

In an embodiment of the liquid ejection head of the present invention, the first protecting film and the second protecting film have a flow passage-side end portion having a structure such that an end surface of one of the protecting films is covered with the other protecting film is covered with the one of the protecting films. This structure will be described more specifically with reference to FIGS. 1(*a*) and 1(*b*).

In FIGS. 1(*a*) and 1(*b*), on a front surface (upper surface) of a substrate 11 of single crystal silicon, a thermal silicon oxide film 12 is formed. On part of the thermal silicon oxide film 12, a recording element 13 is provided. A silicon oxide film 14 is provided on the thermal silicon oxide film 12 and the recording element 13 so as to cover the recording element 13 by a plasma enhanced CVD (PECVD). On the silicon oxide film 14 provided by the PECVD, a liquid flow passage 23 defined by an orifice plate 16 is provided. The orifice plate 16 is provided with a liquid ejection outlet 17 correspondingly to the recording element 13. In the liquid flow passage 23, an area opposite to the recording element 13 is a pressure generation chamber 24. The thermal silicon oxide film 12 and the silicon oxide film 14 provided by the PECVD constitute a lamination film as a first protecting film 25. On a back surface (lower surface) of the substrate 11, an oxide film 26 is provided. As the recording element 13, it is possible to use a heater, a heat generating resistor, or the like.

An inner wall surface of the substrate 11 facing a liquid supply port 20 which penetrate through the substrate 11 and is connected to the liquid flow passage 23 is covered with a polyparaxylylene resin film 21 (herein, referred to as a "second protecting film").

In FIG. 1(*a*), an end surface of the second protecting film is covered with the first protecting film and part of an end surface of the first protecting film is covered with the second protecting film.

Incidentally, the end surface of the first protecting film is perpendicular to the front surface of the substrate 11 and the end surface of the second protecting film is parallel to the front surface of the substrate 11.

In FIG. 1(*b*), the end surface of the first protecting film is covered with the second protecting film and part of the end surface of the second protecting film is covered with the first protecting film.

When the first protecting film and the second protecting film have the structure shown in FIGS. 1(*a*) and 1(*b*), these protecting films contact each other at two or more surfaces. As a result, a length of the interface between the first protecting film and the second protecting film is longer than that of a conventional structure such that the end surface of one of the protecting film is covered with the other protecting film by a degree of extension of one protecting film into the other protecting film. By the increased length of the interface, it is possible to reduce a degree of permeation of the liquid. Further, it is also possible to improve adhesiveness between the first protecting film and the second protecting film.

As the first protecting film, a silicon oxide film or a silicon nitride film may preferably be used. The first protecting film may also be a lamination film of the silicon oxide film and/or the silicon nitride film.

Figure 4:
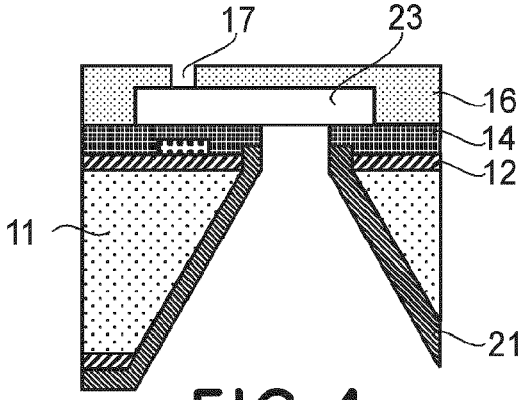
FIG. 4 is a sectional view showing another embodiment of a supply port provided with a protecting film in the ink jet head of the present invention.

FIG. 4 shows a modified embodiment in which the wall surface of the substrate defining the liquid supply port is formed with an inclination angle with respect to the flat surface of the substrate. In the case where the liquid supply port is formed by crystal anisotropic etching, the inclination angle is 54.7 degrees. Also in the cases where the supply port is formed by dry etching, wet etching, laser processing (machining), sand-blast, and other mechanical processings (machinings), the resultant liquid supply port may be provided with an inclined portion (tapered portion).

Figure 6:
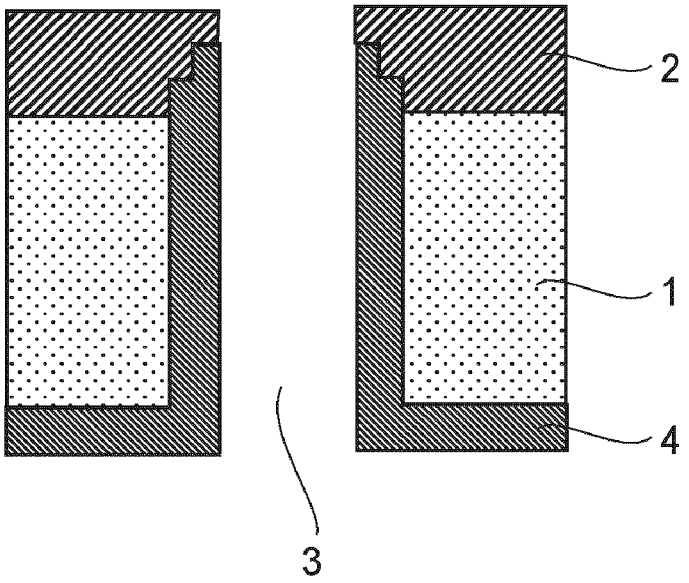
FIGS. 6 and 7 are sectional views each showing another embodiment of a supply port provided with a protecting film in the ink jet head of the present invention.
Figure 7:
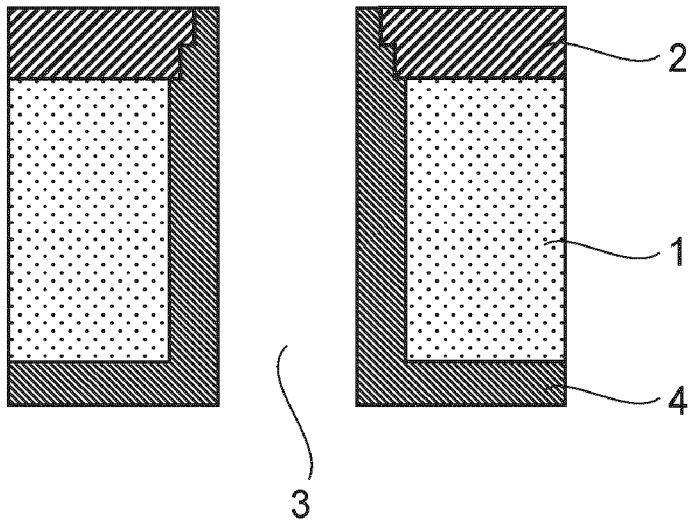

FIGS. 6 and 7 shows other modified embodiments.

In FIGS. 1(*a*) and 1(*b*), the protecting films are combined with each other with a single stepped portion. In FIGS. 6 and 7, the protecting films are combined with each other with two stepped portions. It is also possible to employ three or more stepped portions.

The second protecting film may preferably have an anti-ink (liquid) property in order to protect the substrate from the liquid such as the ink.

As a film having the anti-ink (liquid) property in the case where the organic resin film is used, it is possible to a film selected from the group consisting of a polyparaxylylene film, a polymonochloroparaxylylene film, a polydichloroparaxylylene film, a polytetrafluoroparaxylylene film, another paraxylylene derivative film (hereinafter, these films are referred to as a "polyparaxylylene resin film"), a polyurea resin film, and a polyimide resin film. It is also possible to use lamination films using these films in combination.

In the case where the film is formed of the inorganic material, the silicon oxide film may preferably be used.

In the case of using the polyparaxylylene resin film, a suitable type of a film can be selected in view of a material cost and a required heat resistivity. Further, these films may also be laminated. For example, after the silicon oxide film is formed at the liquid supply port, the polyparaxylylene resin film may be formed on the silicon oxide film. As a result, the silicon oxide film having a hydrophilic group can achieve a high degree of effectiveness as a silane coupling agent, so that adhesiveness of the polyparaxylylene resin film to the silicon oxide film is improved.

A manufacturing method of the structure shown in FIG. 1(*a*) will be described with reference to schematic sectional views of FIGS. 5(*a*) to 5(*f*) showing manufacturing steps.

In this embodiment, as a substrate 1, a single crystal silicon substrate was used. The single crystal silicon substrate may preferably be a single crystal silicon wafer having (100) surface as a crystal orientation surface and may preferably have a thickness of about 10-1000 μm.

Figure 5:
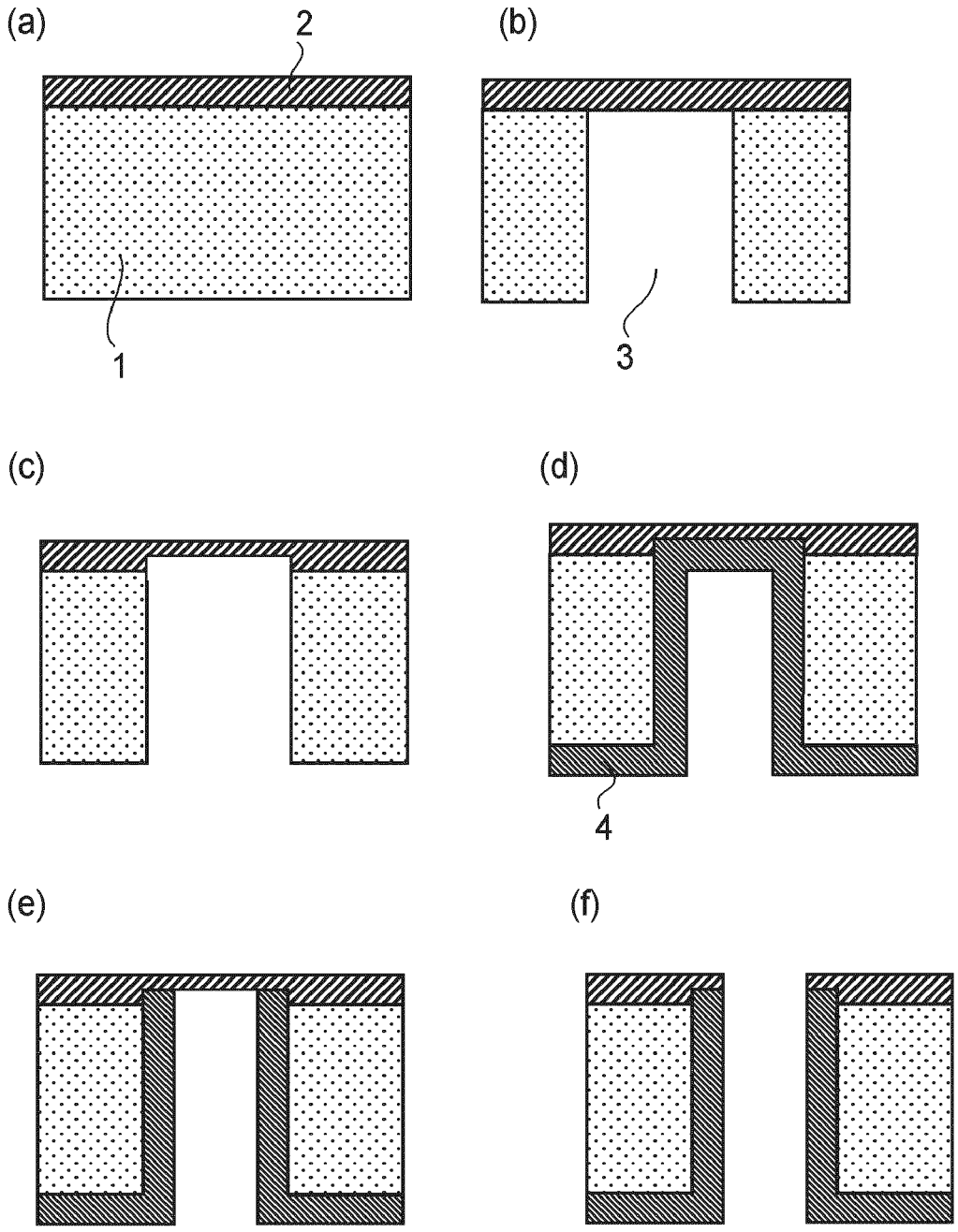
FIGS. 5(*a*) to 5(*f*) are sectional views for illustrating an embodiment of a manufacturing method of a substrate provided with a protecting film and an opening in the present invention.

On the substrate 1, a first protecting film 2 is formed (FIG. 5(*a*)). As the first protecting film 2, e.g., the silicon oxide film may suitably be used. The first protecting film 2 can be formed by a thermal oxidation method, a CVD method, a PECVD method, and the like. Other than the silicon oxide film, it is also possible to use the silicon nitride film, a silicon oxynitride film, and a lamination film of these films. The silicon oxide film, the silicon nitride film, the silicon oxynitride film, and the lamination film of these films are inclusively referred to as a "silicon-based insulating film".

The first protecting film 2 may preferably have a thickness of about 500 nm to about 5000 nm. In the case where the silicon oxide film is formed by the thermal oxidation method, the first protecting film may also be formed on both surfaces of the substrate. When the first protecting film is formed on the both surfaces of the substrate, the first protecting film can function as an etching mask in a subsequent step of forming an opening 3.

Next, as shown in FIG. 5(*b*), the opening 3 is formed by removing the substrate 1 with a desired opening width from a back surface side of the substrate until the removed portion reaches the first protecting film 2. As a method of forming the opening 3, it is possible to use a dry etching method which is a so-called Bosch process in which the substrate is removed by repeating a deposition step and an etching step. In this case, when the silicon oxide film is BPSG (boro-phospho silicate glass) is used at the material for the first protecting film 2, it is possible to sufficiently ensure an etching selection ratio between the substrate 1 and the first protecting film 2. Further, the silicon oxide film can also be suitably used as the etching mask formed on the back surface of the substrate 1.

As a method of forming the opening 3, it is also possible to use an RIE (reactive ion etching) method, a CDE (chemical dry etching) method, other dry etching methods, the crystal anisotropic etching method, other wet etching methods, the laser processing method, the sand-blast method, and other mechanical processing methods. As desired, after a resist material capable of ensuring a desired etching selection ratio is formed on the substrate back surface, the substrate removal may also be removed by patterning the substrate in a desired shape.

Then, as shown in FIG. 5(*c*), the first protecting film 2 is partially removed through the opening 3 to a degree such that the opening 3 penetrates through the first resin film 2. A depth of the removal may preferably be about 10% to about 90% per the thickness of the first protecting film 2.

As a method for removing the first protecting film 2, it is possible to use the RIE method, an ion milling method, the laser processing method, and other mechanical processing methods although the method varies depending on the type of the first protecting film 2. For example, in the case where the first protecting film 2 is the silicon oxide film, it is possible to use the RIE method.

Then, as shown in FIG. 5(*d*), a second protecting film 4 is formed to narrow the opening 3 from the substrate back surface.

As the second protecting film 4, e.g., the polyparaxylylene resin film, the polyurea resin film, the polyimide resin film, and the silicon oxide film can be suitably used. In the case where the polyparaxylylene resin film is used, a suitable type thereof is selectable in view of the material cost and required heat resistance. However, the polyparaxylylene resin film has a slow deposition speed onto the substrate, so that the polyparaxylylene resin film is formed while cooling the substrate. As a method of forming the second protecting film 4, it is possible to suitably use the CVD for the polyparaxylylene resin film, vapor deposition polymerization for the polyurea resin film, sputtering, dipping or spray application for the polyimide resin film, and the CVD or the sputtering for the silicon oxide film. The second protecting film 4 may preferably have a thickness of 1 μm or more and 10 μm or less.

Next, as shown in FIG. 5(*e*), the second protecting film 4 located at a bottom of the opening 3 is removed from the back surface side of the substrate through the opening 3.

As the removing method, it is possible to use one or a plurality of methods including the RIE method, the ion milling method, the laser processing method, the sandblast method, and other mechanical processing methods. For example, in the case where the second protecting film 4 is the polyparaxylylene resin film, the second protecting film 4 can be removed by the RIE method using a dry film resist as the etching mask.

Finally, as shown in FIG. 5(*f*), a residual portion of the first protecting film 2 located at the bottom of the opening 3 is removed. When the first protecting film 2 is the silicon oxide film, after the second protecting film 4 is removed, the first protecting film 2 can be removed by using the RIE method under a changed etching condition.

The removing method of the first protecting film 2 varies depending on the materials for the first protecting film 2 and the second protecting film 4 but can be one or a plurality of methods including the RIE method, the CVD method, other dry etching methods, the wet etching method, the ion milling method, the laser processing method.

Through the above-described steps, the protecting film structure as shown in FIG. 1(*a*) can be easily formed.

In order to obtain the structure shown in FIG. 6, after the second protecting film 4 located at the bottom of the opening 3 constituting the liquid supply port 20 is removed (FIG. 5(*e*)), part of the first protecting film 2 is removed. Thereafter, the second protecting film is further formed. Then, after the second protecting film 4 located at the bottom of the opening 3 is removed, the first protecting film 2 is removed at the bottom of the opening 3.

Further, similarly, it is also possible to form the substrate provided with the protecting films and the opening as shown in FIG. 1(*b*) by applying the above-described steps.

Embodiment

A manufacturing method of the liquid ejection head according to the present invention will be described more specifically with reference to FIGS. 8(*a*) to 8(*h*) which are process sectional views.

Figure 8:
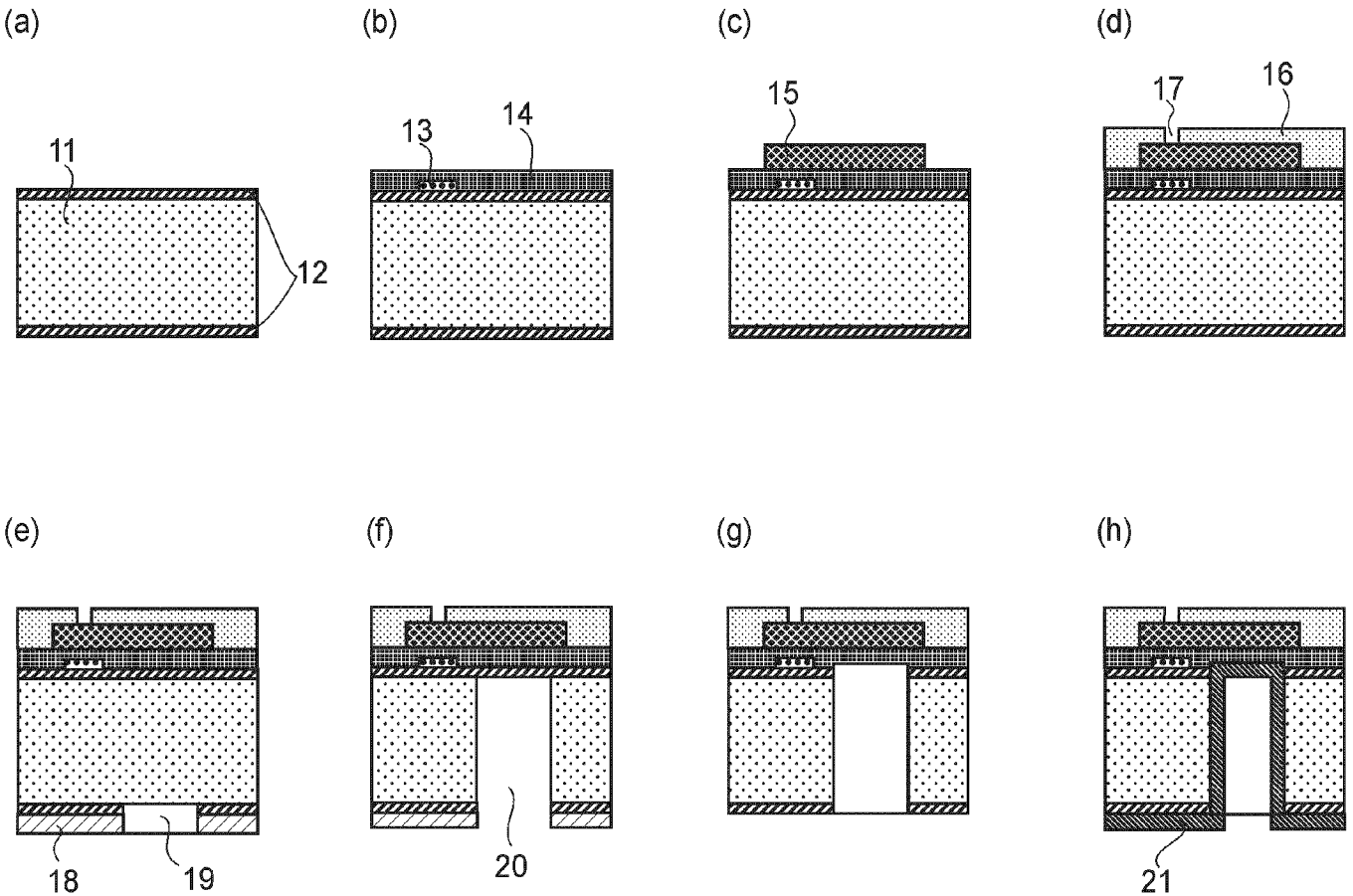
FIGS. 8(*a*) to 8(*h*) and FIGS. 9(*a*) to 9(*c*) are sectional process views for illustrating a manufacturing method of an ink jet head according to the present invention.

At both surfaces of a silicon substrate 11 of single crystal silicon having (100) surface as a crystal face direction, a 500 nm-thick silicon oxide film 12 was formed by using thermal oxidation (FIG. 8(*a*)).

Next, on one of the surfaces of the substrate 11, a recording element 13 and a driving circuit (not shown) for driving the recording element 13 were formed by using a normal semiconductor manufacturing method. The surface on which the recording element 13 was formed is referred to as a "front surface".

Next, in order to insulate and protect the recording element 13 and the driving circuit from liquid such as ink, a 1000 nm-thick silicon oxide film 14 was formed by using the PECVD method.

That is, on the front surface of the substrate 11, the silicon oxide film firmed formed by the thermal oxidation and the silicon oxide film subsequently formed by the PECVD method were provided in a total thickness of about 1500 nm (FIG. 8(*b*)).

Next, as shown in FIG. 8(*c*), a positive resist ("ODUR", mfd. by TOKYO OHKA KOGYO CO., LTD.) principally comprising polymethyl isopropenyl ketone for constituting a liquid flow passage molding material 15 which can be eluted by treatment described later was formed on the silicon oxide film 14 by spin coating and was formed in a desired pattern by exposure and development with deep UV light.

On the liquid flow passage molding material 15, a cation polymerization type epoxy resin material for constituting an orifice plate 16 was spin-coated and was subjected to exposure and development to form a liquid ejection outlet 17 (FIG. 8(*d*)).

Next, the thermal silicon oxide film 12 on a back surface of the substrate 11 was subjected to patterning with a positive resist 18 ("OFPR", mfd. by TOKYO OHKA KOGYO CO., LTD.) as a mask by the RIE method principally using $CF_4$ gas to form an opening 19 for defining a position for forming a liquid supply port (FIG. 8 (*e*)). The positive resist 18 is not removed at this stage in order to also function as a mask for subsequent dry etching.

Then, as shown in FIG. 8(*f*), the dry etching was performed from the opening 19 provided to the silicon oxide film 12 on the back surface side of the substrate 11 by using an ICP (inductively coupled plasma) etching device. As an etching gas, $SF_6$ gas and $C_4F_8$ gas were used and the Bosch process in which the etching step and the deposition step were alternately repeated was employed. In this step, the silicon oxide film 12 formed on the front surface of the substrate 11 functioned as an etching step layer.

Next, through the liquid supply port 20 formed from the back surface of the substrate 11, the silicon oxide film on the front surface side was removed in a depth of 700 nm (to a degree such that the liquid supply port 20 penetrated through the silicon oxide film) by the RIE method principally using $CF_4$ gas. Then, the positive resist functioning as the mask was removed (FIG. 8(*g*)).

Next, as shown in FIG. 8(*h*), on the back surface of the substrate 11, a 3 μm-thick polyparaxylylene resin film 21 was formed by the CVD method. The polyparaxylylene resin film 21 was formed in a uniform thickness at a wall surface and a bottom surface which defined the liquid supply port 20.

Figure 9:
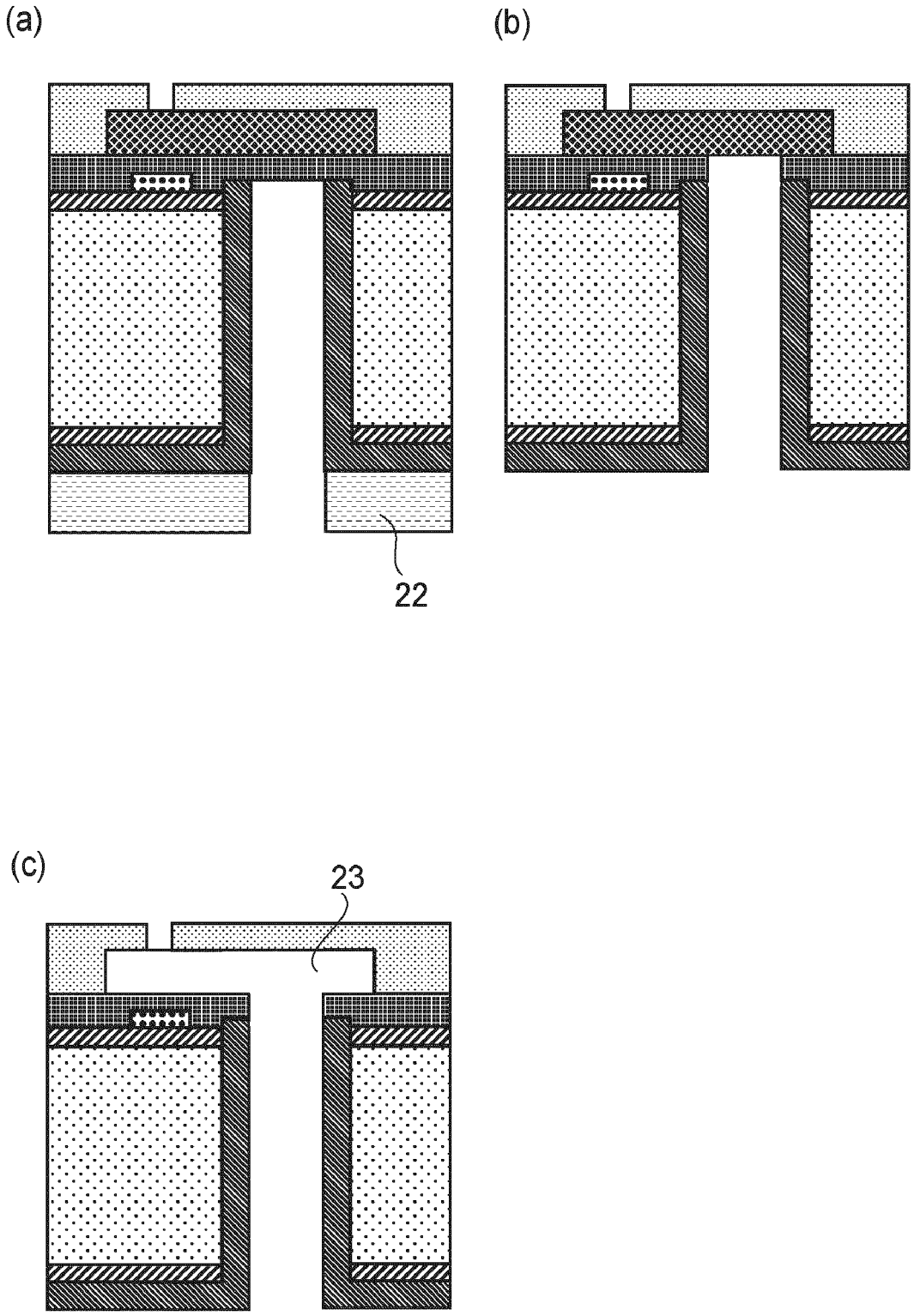

Next, as shown in FIG. 9(*a*), the polyparaxylylene resin film 21 located at the bottom defining the liquid supply port 20 was removed by using a dry film resist 22 as a mask and using the RIE method principally employing $O_2$ gas.

After, the dry film resist 22 was removed, the silicon oxide film 12 located at the bottom on the front surface side of the substrate 11 was removed from the back surface side through the liquid supply port 20 by using the RIE method principally using $CF_4$ gas, so that the liquid supply port 20 penetrated between the front surface and the back surface of the substrate 11. In this step, the liquid flow passage molding material 15 formed on the front surface side functioned as the etching stop layer (FIG. 9(*b*).

Thereafter, the position resist as the exposed to UV light emitted from above the orifice plate 16 and was immersed in methyl lactate to be eluted, so that a liquid flow passage 23 was formed. Finally, the resultant structure (wafer) was sufficiently washed with water and dried and thereafter the wafer was separated into chips by a dicer to complete a liquid ejection head (FIG. 9(*c*)).

(Improvement Experiment of Protecting Performance)

In order to confirm an improvement in protecting property (performance) of the protecting films which protect the substrate from the liquid such as the ink, the following experiment was conducted.

A sample for the experiment was prepared in the following manner. After a 500 nm-thick first silicon oxide film was formed on both surfaces of a silicon substrate of single crystal silicon having (100) surface as a crystal face direction by using the thermal oxidation, a 1000 nm-thick second silicon oxide film was formed on one of surfaces of the substrate by the PECVD method.

Thereafter, a photoresist film was formed on the surface at which the first silicon oxide film was exposed and then an opening was formed by using normal lithography. After the first silicon oxide film was removed by etching through the opening, the substrate was etched by using the Bosch process so that the opening reached the first silicon oxide film formed on the other surface of the substrate.

Thereafter, the silicon oxide film was removed in a depth of 700 nm by etching through the opening.

Next, a 2 μm-thick polyparaxylylene resin film was formed by using the CVD method and thereafter the polyparaxylylene resin film located at the bottom defining the opening was removed by using a dry film resist as a mask and using the RIE method principally employing $O_2$ gas.

Finally, the remaining portion of the first protecting film (the silicon oxide film) located at the bottom was removed by the RIE method to prepare the sample for experiment.

As a comparative experiment, after the opening was formed to penetrate through the substrate, the 2 μm-thick polyparaxylylene resin film was formed without removing the first resin film and then the polyparaxylylene resin film at the bottom defining the opening was removed by using the RIE method principally employing $O_2$ gas. Finally, all the first protecting film portions were removed from the opening side by the RIE method to prepare a sample for the comparative experiment.

Next, each of both of the samples was placed in a teflon jar containing 30 ml of ink adjusted to pH=9 so as to be immersed in the ink in a hermetically sealed state. In order to accelerate a reaction speed between the ink and the substrate, the jar was held in a constant-temperature oven set at 70° C. for 5 weeks and thereafter was taken out of the oven. The sample was sufficiently washed with water. After the sample was dried sufficiently, a portion of the sample in the neighborhood of the interface between the first protecting film 2 and the second protecting film 4 was processed by FIB (focused ion beam) and a cross section of the portion was observed according to SEM (scanning electron microscopy).

In the sample for the comparative experiment, about several μm of corrosion of silicon constituting the substrate was observed with respect to vertical and horizontal directions. On the other hand, in the sample for the experiment, a degree of the corrosion of silicon was considerably reduced.

From these results, an effect of the present invention is clear. That is, the substrate protecting property was improved by the shape of one of the protecting films extending into the other protecting film.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 046074/2008 filed Feb. 27, 2008, which is hereby incorporated by reference.

What is claimed is:

1. A liquid ejection head comprising:

a substrate, having a front surface and a back surface, provided on the front surface with an energy generating element for generating energy used for ejecting liquid;

a supply port, provided so as to penetrate between the front surface and the back surface of said substrate, for supplying the liquid to the energy generating element;

a first film provided on the front surface of said substrate; and a second film provided so as to coat a wall of said substrate defining said supply port, wherein said first film and said second film have surface contact with each other with respect to two directions substantially perpendicular to each other.

2. The head according to claim 1, wherein said first film coats the energy generating element.

3. The head according to claim 1, wherein said second film is formed of a material selected from the group consisting of polyparaxylylene, polymonochloroparaxylylene, polydichloroparaxylylene, polytetrafluoroparaxylylene, another paraxylylene derivative, polyurea resin, and polyimide resin.

* * * * *